United States Patent [19]

Rowlee

[11] 4,397,633

[45] Aug. 9, 1983

[54] FUEL OIL HEATER

[76] Inventor: Charles G. Rowlee, P.O. Box 434, Finland, Minn. 55603

[21] Appl. No.: 296,673

[22] Filed: Aug. 27, 1981

[51] Int. Cl.[3] ..... F23D 11/44

[52] U.S. Cl. ..... 431/215; 431/161; 431/38; 137/334

[58] Field of Search ..... 431/215, 161, 207, 38, 431/37, 208; 137/334

[56] References Cited

U.S. PATENT DOCUMENTS

| | | | |
|---|---|---|---|
| 1,403,954 | 1/1922 | Herrin | 431/211 |
| 2,263,833 | 11/1941 | Aldrich | 137/334 |
| 4,191,524 | 3/1980 | Thorn | 431/208 |
| 4,249,885 | 2/1981 | Reich | 431/208 |

*Primary Examiner*—Carroll B. Dority, Jr.
*Attorney, Agent, or Firm*—Howard I. Podell

[57] ABSTRACT

Apparatus for heating the fuel oil exiting from an oil supply tank and in the supply pipe leading to an oil burner furnace. The return oil line, from the pressure relief valve in the oil burner unit, is led to a coil fitted about the furnace stack leading from the oil burner furnace. The outlet of this heating coil is then led into a metal tempering box, mounted below the tank, through a pipe banded to the supply pipe so as to warm the oil in the supply pipe and the oil in the tempering box. Supply oil is fed from the oil supply tank into the tempering box, to mix with the heated oil in the tempering box, with the mixed warmed oil led from the tempering box into the supply pipe leading to the oil burner of the furnace.

6 Claims, 5 Drawing Figures

FUEL OIL HEATER

BACKGROUND OF THE INVENTION

Prior inventions in the field of my invention or disclosed in the following U.S. Pat. Nos: 4,095,933; 1,746,969; 3,938,934; 2,575,867; 3,199,568; 1,121,695; 1,846,939; 2,647,567; 3,241,594; 3,840,321; 1,403,954; and 1,509,706.

These prior inventions do not suggest the simplicity or the effectiveness of my invention which provides for an inexpensive means of heating fuel oil in a tank and in a supply line leading to an oil burner.

SUMMARY OF THE INVENTION

My invention is an apparatus for heating the fuel oil in a tempering box below an oil supply tank and in the supply pipe leading to an oil burner furnace. The return oil line, from the pressure relief valve in the oil burner unit, is led to a coil fitted about the furnace stack leading from the oil burner furnace. The outlet of this heating coil is then led into a metal tempering box, mounted to the tank, through a pipe banded to the supply pipe so as to warm the oil in the supply pipe and the oil in the tempering box. Supply oil is fed from the oil supply tank into the tempering box to mix with the heated oil in the tempering box, with the oil supply pipe leading from the tempering box to the oil burner of the furnace.

By means of my invention, the oil exiting from the outlet of an oil supply tank of an oil burner is warmed so as to reduce its viscosity and to improve its flow characteristics through the supply line, which is also heated by the waste heat from the furnace stack of the oil burner furnace.

BRIEF DESCRIPTION OF THE DRAWINGS:

The objects and features of the invention may be understood with reference to the following detailed description of an illustrative embodiment of the invention, taken together with the accompanying drawings in which.

DESCRIPTION OF THE PREFERRED EMBODIMENT

Figure 1:
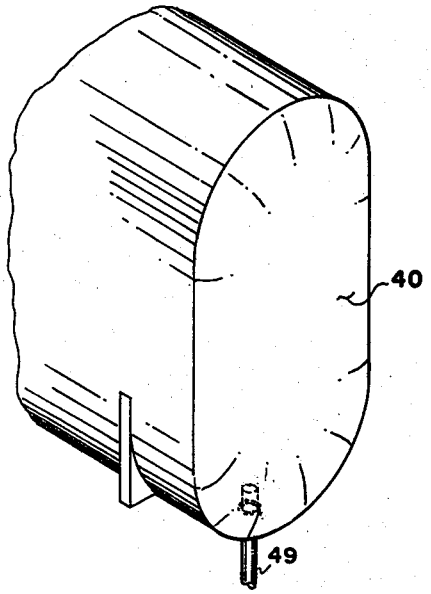
FIG. 1 is a detail sectional view of the fuel tank section of my invention.
Figure 2:
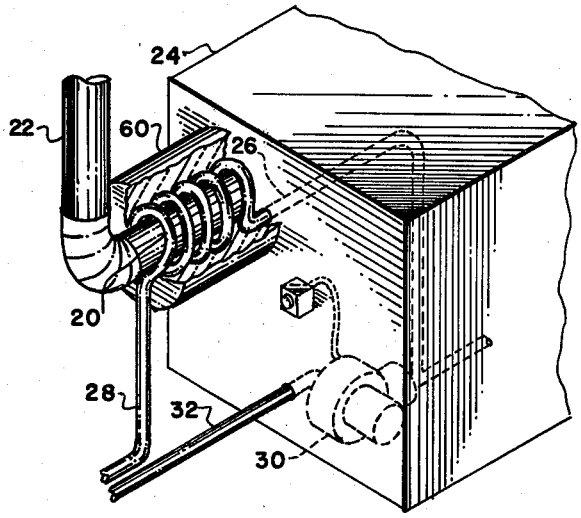
FIG. 2 is a detail perspective view of the furnace section of my invention.
Figure 3:
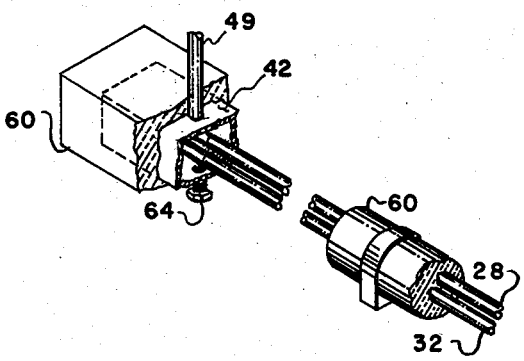
FIG. 3 is a detail sectional view of the oil lines of my invention.
Figure 3:
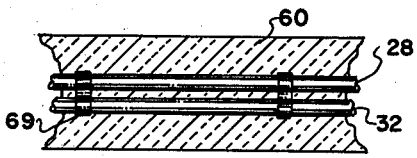
Figure 4:
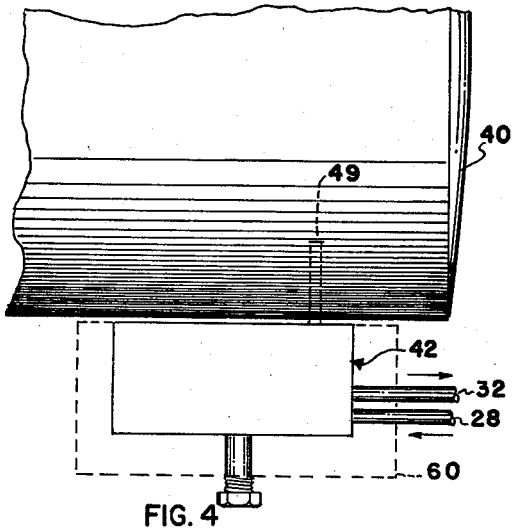
FIG. 4 is a detail side view of the fuel tank section.
Figure 5:
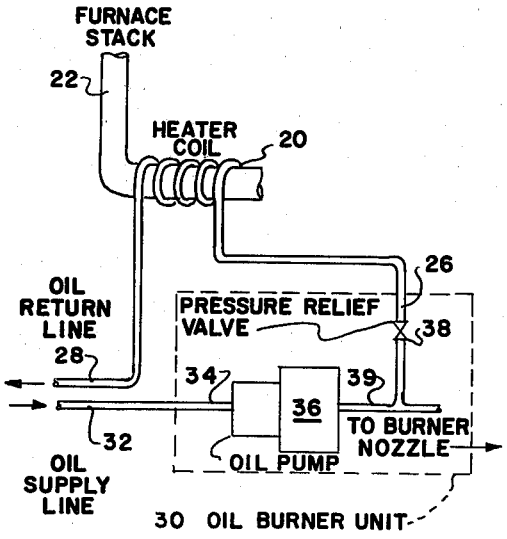
FIG. 5 is a schematic view of the oil burner section of the invention.

Turning now descriptively to the drawings, in which similar reference characters denote similar elements throughout the several views, FIGS. 1–5 illustrate my invention which includes a heating coil 20 mounted about the furnace stack 22 leading from an oil burner furnace 24, through which coil, the oil from the fuel return line 26 leading from the oil burner unit 30 passes. The coil 20 is joined at its outlet to an oil return line 28 that is banded by clamps 69 to the oil supply line 32 leading from the fuel tank 40 to the fuel inlet 34 of the pump 36 of the oil burner unit. The outlet 39 of the pump 36 is led in customary fashion to the oil burner nozzle, with the pressure relief valve 38 leading from the pump outlet to the return line 26. The return line 28 leads heated oil from coil 20 into the interior of the hollow tempering box 42, which is mounted below the oil supply tank 40 as shown in FIGS. 1, 4.

The heated oil from return line 28 mixed in the tempering box with cold oil drawn into box 42 through metal outlet tube 49 from tank 40, with the warmed mixed oil now led through supply line 32 to pump 36.

The coil 20, box 42 and the banded supply and return line are each covered preferably with insulation 60.

Supply line 32 draws oil from the tempering box to the oil pump 36. A drain plug 64 may be mounted in the tempering box.

The heated oil in the return line warms the oil flowing in the supply line, and mixes with and warms the oil fed from the tank into the tempering box. Heat from the tempering box is also conducted through metal outlet tube 49 into the tank 40 to warm oil in tank 40.

Tests of the invention in actual use showed that within the first seven minutes of use, oil in the tempering box was warmed to above 40° F., with oil in the supply tank being at 10° F.

The following is a record of tests actually made of the invention in use, with all temperatures indicated in degrees F. The tank was outdoors, six feet from the house, raised above ground and clear of all shelter except for the tempering box.

Feb. 6, 1980

7:40 PM pumped approximately 30 gallons of fuel into tank

Feb. 6, 1980

Started tests at 7:45 PM. 1" Styrofoam insulation on tempering box ¼" foam on lines from tank to burner. 1" compressed fiberglass insulation on coil at stack. At start up, fuel tank temperature was +10°, tempering tank was +21°. Ambient temperature +12°. After first furnace cycle of seven minutes the tempering box temperature was +44°. The second cycle from 8:13 PM to 8:17 PM the tempering box reached a temperature of +51°.

Feb. 7, 1980

3:30 AM. Tempering Box 44°
Ambient temperature +8°
7:00 AM. Tempering Box +32°, furnace off.
Fuel tank 0°
12:10 PM. Tempering Box +30°
Fuel Tank +22°
5:30 PM. Tempering box +40°
Tank temperature +12°. These temperatures after insulating lines with four inches of building fiberglass insulation. Furnace running at time.

Feb. 7, 1980

5:50 PM. Pumped 30 gallons fuel into tank.
7:20 PM. Furnace running. Tempering box +42°. Tank +12°
8:55 PM. Furnace off. Tempering box +32°. Tank +2°.
9:40 PM. Furnace on. Tempering box +40°. Tank −4°.
Furnace on.
11:30 PM. Tempering box +40°. Tank −6°.

Feb. 8, 1980

5:50 AM. Tempering box +41°. Tank −5°. Furnace just came on
7:05 AM. Tempering box +42°. Tank −2°. Furnace just came on
Noon. Tempering box +46°. Tank +28°. Furnace on 5:20 PM. Tempering box +44°. Tank +12°. Furnace on Feb. 9, 1980

1:55 AM. Tempering box +46'. Tank +8°. Furnace on.

House thermometer +12°.

7:00 AM. Tempering box +44°. Tank +3°. Furnace on.

House thermometer °8°

Feb. 9, 1980

5:30 PM. Pumped 30 gallons fuel into tank

6:00 PM. Tempering box +36°. Tank +9°. Furnace off.

House thermometer +16°

7:08 PM. Tempering box +32°. Tank +5°. Furnace off

7:15 PM. Tempering box +40°. Tank Furnace on

10:00 PM. Tempering box +32°. Tank +8°. Furnace off

Feb. 10, 1980

6:00 AM. Tempering box +46°. Tank +3°. Furnace on.

House thermometer +10°

8:40 PM. Tempering box +42°. Tank +12°. Furnace on

9:45 PM. Tempering box +38°. Tank +12°. Furnace on

10:08 PM. Tempering box +42°. Tank +10°. Furnace just came on

Feb. 11, 1980

2:45 AM. Tempering box +44°. Tank +12°. Furnace on

6:50 AM. Tempering box +34°. Tank +8°. Furnace off

Feb. 28, 1980

10:30 PM. Tempering box +40°. Tank −24°. Furnace running

Feb. 29, 1980

7:00 AM. Tempering box +40°. Tank −24°. Furnace running

7:05 AM. Tempering box +20° Furnace off

Mar. 1, 1980—6:00 AM. Tempering box +38°. Tank −30°.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. Apparatus for heating the fuel oil that is supplied to an oil burner furnace, where the oil burner furnace is fitted with an oil burner unit that pumps oil from a supply line leading from a fuel tank into an oil burner nozzle and also pumps oil through a pressure relief valve to an oil return line, and where the furnace is fitted with a stack to carry hot exhaust furnace gases to a flue comprising means to heat the oil in the return line utilizing the heat of the exhaust gases of said stack, and means to heat the oil in the supply line utilizing the heat of the oil heated in the return line.

2. The invention recited in claim 1 in which the means to heat the oil in the return line comprises a coil mounted about the stack, which coil is fitted between the section of the return line leading to the fuel tank and the section of the return line leading from the oil burner unit.

3. The invention as recited in claim 1 in which the means to heat the oil in the supply line comprises mounting together sections of the supply line and the return line leading from the fuel tank to the oil burner unit along a substantial portion of their length.

4. The invention as recited in claim 1 in which the means to heat the oil in the supply line comprises a hollow tempering box, with the return line leading from the means to heat the oil in the return line into said tempering box, and with the supply line extending from the interior of said tempering box to the oil burner unit, with an outlet of the fuel tank extending into the said tempering box.

5. The combination as recited in claim 4 in which the tempering box is mounted below the fuel tank, and enclosed in thermal insulation.

6. The combination as recited in claim 3 in which the said sections of the return line and supply line are clamped together and enclosed in thermal insulation.

* * * * *